US010716454B2

(12) United States Patent
Suzuki et al.

(10) Patent No.: US 10,716,454 B2
(45) Date of Patent: Jul. 21, 2020

(54) SHOE-WASHING DEVICE

(71) Applicants: QINGDAO HAIER WASHING MACHINE CO., LTD., Qingdao, Shandong (CN); HAIER ASIA CO., LTD, Tokyo (JP)

(72) Inventors: Hazime Suzuki, Tokyo (JP); Shigeharu Nakamoto, Tokyo (JP)

(73) Assignees: QINGDAO HAIER WASHING MACHINE CO., LTD., Qingdao, Shandong (CN); AQUA CO., LTD., Tokyo (JP)

( * ) Notice: Subject to any disclaimer, the term of this patent is extended or adjusted under 35 U.S.C. 154(b) by 194 days.

(21) Appl. No.: 15/766,324

(22) PCT Filed: Oct. 9, 2016

(86) PCT No.: PCT/CN2016/101568
§ 371 (c)(1),
(2) Date: Apr. 5, 2018

(87) PCT Pub. No.: WO2017/059816
PCT Pub. Date: Apr. 13, 2017

(65) Prior Publication Data

US 2018/0289237 A1 Oct. 11, 2018

(30) Foreign Application Priority Data

Oct. 9, 2015 (JP) ..... 2015-201222

(51) Int. Cl.
*A47L 23/02* (2006.01)
*D06F 58/00* (2020.01)
(Continued)

(52) U.S. Cl.
CPC ..... *A47L 23/02* (2013.01); *A47L 23/18* (2013.01); *A47L 23/20* (2013.01); *A47L 23/205* (2013.01); *D06F 17/04* (2013.01); *D06F 58/00* (2013.01)

(58) Field of Classification Search
CPC ..... A47L 23/02; A47L 23/18; A47L 23/20; A47L 23/205; A47L 23/04; A47L 23/06;
(Continued)

(56) References Cited

U.S. PATENT DOCUMENTS 3,293,890 A * 12/1966 Valdespino ..... D06F 17/04 68/21
3,868,835 A * 3/1975 Todd-Reeve ..... D06F 17/04 68/20
2002/0189039 A1* 12/2002 Schlem ..... A47L 23/02 15/104.92

FOREIGN PATENT DOCUMENTS

CN 201147293 11/2008
CN 201469236 5/2010
(Continued)

OTHER PUBLICATIONS

Extended European Search Report for Application No. 16853120.0 dated Apr. 18, 2019, 7 pages.
(Continued)

*Primary Examiner* — Robert J Scruggs
(74) *Attorney, Agent, or Firm* — Greenberg Traurig

(57) ABSTRACT

A shoe-washing device capable of efficiently dewatering cleaned shoes. The shoe-washing device includes: an accommodating chamber supplied with cleaning fluid; a plurality of holding parts each being hollow and having an opening part, the opening parts of the holding parts are inserted into an inner space of a shoes from toplines of the shoes inside the accommodating chamber such that the shoe are held in such a manner that the toplines face a lower side
(Continued)

and the opening parts faces the inner space of the shoes; a pipe connected to the holding part; and an air supply part for supplying air into the holding parts through the pipe.

4 Claims, 5 Drawing Sheets

(51) Int. Cl.
*D06F 17/04* (2006.01)
*A47L 23/20* (2006.01)
*A47L 23/18* (2006.01)

(58) Field of Classification Search
CPC ..... A47L 23/14; A47L 23/16; A47L 23/28; D06F 17/04; D06F 58/00
See application file for complete search history.

(56) References Cited

FOREIGN PATENT DOCUMENTS

| | | | | |
|---|---|---|---|---|
| CN | 201469236 | U | | 5/2010 |
| CN | 102309299 | | | 1/2012 |
| CN | 202096183 | U | | 1/2012 |
| CN | 202168814 | | | 3/2012 |
| CN | 202168814 | U | | 3/2012 |
| DE | 2659484 | A1 | | 7/1978 |
| JP | S6422237 | | | 1/1989 |
| JP | 05228094 | | * | 7/1993 |
| JP | H05228094 | A | | 9/1993 |
| JP | H0642864 | B2 | | 6/1994 |
| JP | H0642864 | | * | 8/1994 |
| KR | 20020036819 | A | | 5/2002 |

OTHER PUBLICATIONS

Japanese Notice of Reasons for Refusal for Application No. 2015-201222 dated Apr. 10, 2019, 6 pages, with translation.

International Application No. PCT/CN2016/101568, International Search Report, dated Jan. 12, 2017.

* cited by examiner

SHOE-WASHING DEVICE

The present application is a national phase application under 35 U.S.C. § 371 of International Patent Application PCT/CN2016/101568, filed on Oct. 9, 2016, which claims priority to Oct. 9, 2015 Patent Application No. 2015-201222, filed on Oct. 9, 2015, the entire disclosures of which applications are hereby incorporated herein by reference.

TECHNICAL FIELD

The present disclosure relates to a shoe-washing device.

BACKGROUND

In a conventional shoe-washing machine, a rotating shaft extending in the up-down direction is arranged in the center of a bottom of an inner drum arranged in an outer drum in a manner of free rotation. A circular wing (also called an impeller) is integrally arranged on a lower part of the rotating shaft. Primary brushes are arranged on the peripheral side surface throughout the rotating shaft and transversely protrudes to the proximity of the inner surface of the inner drum, and secondary brushes are arranged on the wing and protrude upwards. When the rotating shaft rotates in a reverse direction in a state where the inner drum is supplied with water and shoes are put between the rotating shaft and the inner surface of the inner drum, the shoes are rubbed by the primary brush and the secondary brush and is washed. Then, the inner drum and the rotating shaft are rotated simultaneously at high speed to dewater the shoes.

In the conventional shoe-washing machine, when the inner drum and the rotating shaft are rotated at high speed for dewatering, if the soles of the shoes face the inner surface of the inner drum, since water subjected to a centrifugal force is blocked by the soles and can hardly leak from the shoes, the shoes cannot be sufficiently dewatered. In this way, when the dewatered shoes are taken out of the shoe-washing machine, the water accumulated in the shoes may spill from the shoes and get the periphery wet.

SUMMARY

The present disclosure is based on the background described above and aims to provide a shoe-washing device capable of efficiently dewatering washed shoes.

One or more embodiments of the present disclosure provides a shoe-washing device, including: an accommodating chamber for accommodating a pair of shoes and supplied with cleaning fluid; a plurality of holding parts each being hollow and having an opening part, where the opening parts of the holding parts are inserted into inner space of the shoes from toplines of the shoes inside the accommodating chamber such that the shoes are held in such a manner that the toplines face a lower side, and the opening parts face the inner space of the shoes; a pipe connected to the holding parts; and an air supply part for supplying air into the holding parts through the pipe.

In addition, in some embodiments of the present disclosure, the opening parts are arranged in a manner of facing toecaps of the shoes held by the holding parts.

In addition, in the present disclosure, the shoe-washing device also includes a recycling tank for recycling the cleaning fluid from the accommodating chamber; a drainage hole is formed in the pipe, water reaches the interior of the pipe through the opening parts and interiors of the holding parts from the shoes held by the holding parts and drops into the recycling tank through the drainage hole.

In addition, in some embodiments of the present disclosure, the shoe-washing device also includes a heating part for heating air supplied through the pipe to the interior of the holding parts by the air supply part.

According to the embodiments of the present disclosure, in the shoe-washing device, the shoes accommodated in the accommodating chamber are washed using the cleaning fluid supplied to the accommodating chamber. In the accommodating chamber, the hollow holding part is inserted into the inner space of the shoes through the toplines of the shoes, such that the shoes are held in such a manner that the toplines face the lower side. In such a state, the opening parts of the holding parts face the inner space of the shoes. In the shoe-washing device, the air supply part supplies air to the interior of the holding parts through the pipe connected to the holding parts. The air supplied to the interior of the holding parts violently flows into the inner space of the shoes from the opening parts. At this moment, the cleaning fluid and water may seep from the shoes. The seeped water spills from the toplines that faces the lower side. Therefore, the air flows to the inner space of the shoes through the opening parts of the holding parts for multiple times, thus the washed shoe can be efficiently dewatered from the inner space.

In addition, according to some embodiments of the present disclosure, the opening parts of the holding parts are arranged in a manner of facing the toecaps of the shoes held by the holding parts. Thus, the air flowing from the opening parts of the holding parts to the inner space of the shoes is completely filled in the entire inner space, so that the water seeps from the overall shoes. Therefore, the washed shoes can hardly be dewatered.

In addition, according to some embodiments of the present disclosure, a structure, which includes the recycling tank for recycling the cleaning fluid from the accommodating chamber, enables the water passing through the opening parts of the holding parts and the interiors of the holding parts from the shoes held by the holding parts and reaching into the pipe to drop into the recycling tank through the drainage hole formed in the pipe. Thus, the water seeping from the shoes may be recycled in the recycling tank in a manner of preventing the water from attaching to the shoes again. Therefore, the washed shoe can be efficiently dewatered.

In addition, according to some embodiments of the present disclosure, since the air heated by the heating part is supplied through the pipe to the interiors of the holding parts, the air flows into the inner space of the shoes from the opening parts of the holding parts or is completely filled in the accommodating chamber to surround an outer part of the shoes, so that the shoes can be dried.

LIST OF REFERENCE SIGNS

1: shoe-washing device; 3: accommodating chamber; 4: holding part; 7: pipe; 8: air supply part; 9: heating part; 33: opening part; 35: recycling tank; 62B: drainage hole; S: shoe; SH: topline; SN: inner space; ST: toecap; and Z2: lower side.

DETAILED DESCRIPTION

Figure 1:
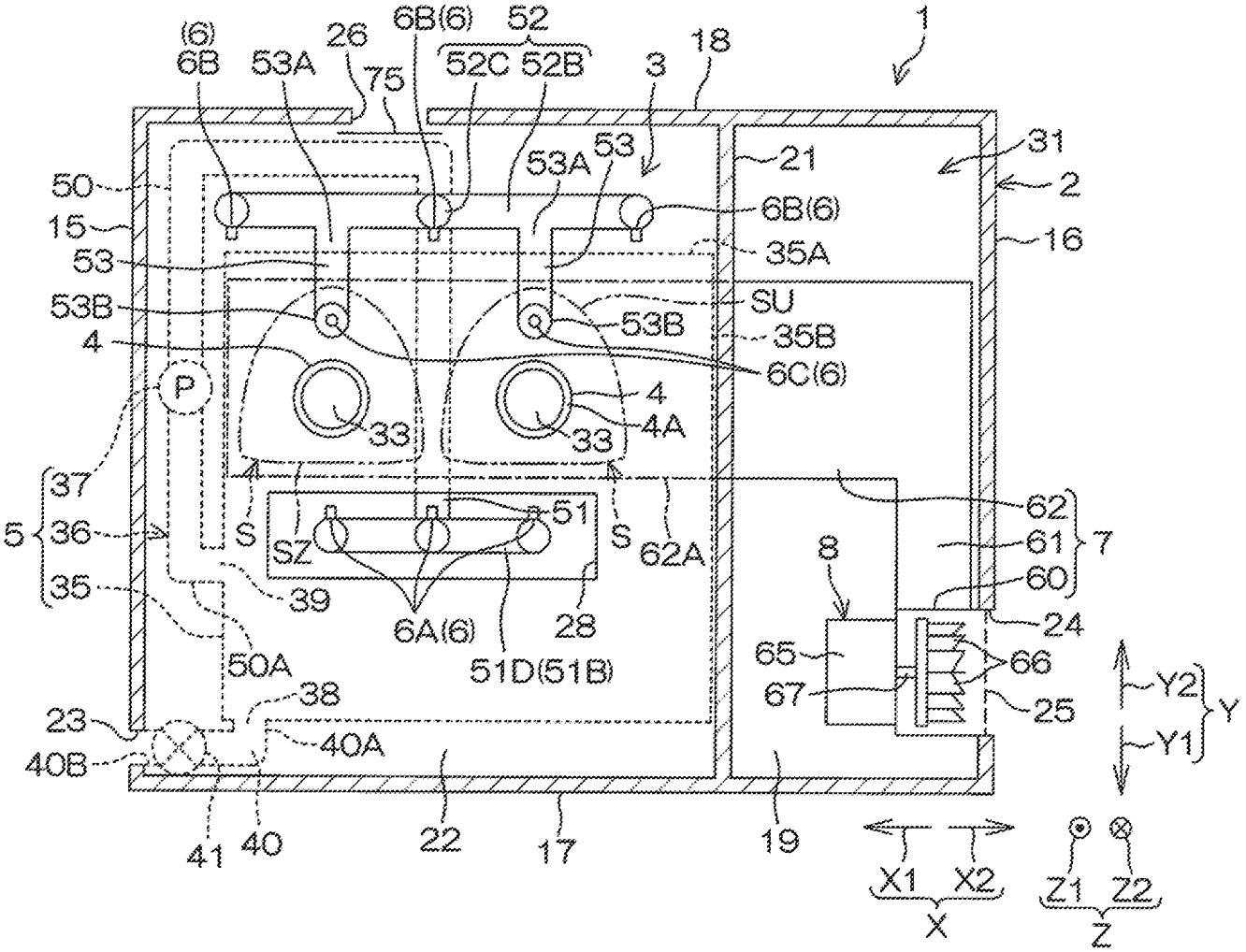
FIG. 1 is a schematic top view illustrating a shoe-washing device in an embodiment of the present disclosure.

Embodiments of the present disclosure are described below in detail with reference to drawings. FIG. 1 is a schematic top view illustrating a shoe-washing device 1 in an embodiment of the present disclosure. Hereinafter, a left-right direction in FIG. 1 is called a left-right direction X of the shoe-washing device 1, an up-down direction in FIG. 1 is called a front-rear direction Y of the shoe-washing device 1, and a direction orthogonal to a paper surface in FIG. 1 is called an up-down direction Z of the shoe-washing device 1. The left-right direction X includes a left side X1 corresponding to a left side of FIG. 1 and a right side X2 corresponding to a right side of FIG. 1. The front-rear direction Y includes a front side Y1 corresponding to a lower side of FIG. 1 and a rear side Y2 corresponding to an upper side of FIG. 1. The up-down direction Z includes an upper side Z1 corresponding to a surface side of the paper surface in FIG. 1 and a lower side Z2 corresponding to an inner side of the paper surface in FIG. 1. The left-right direction X and the front-rear direction Y are included in a horizontal direction, and the up-down direction Z is the same as a vertical direction.

With reference to FIG. 1, the shoe-washing device 1 has an appearance of a shape of approximately rectangular box. The shoe-washing device 1 includes: a housing 2 forming a casing of the shoe-washing device, an accommodating chamber 3 arranged in the housing 2, holding parts 4, an injection mechanism 5, a nozzle 6, a pipe 7, an air supply part 8 and a heating part 9 (see FIG. 2 which will be describe below). For the convenience of illustration, in FIG. 1 and any other figure behind FIG. 1, only the housing 2 is represented as a section view with a section line, and each of members except the housing 2 is represented in a side view.

The housing 2 integrally includes: a left wall 15, a right wall 16, a front wall 17, a rear wall 18, a bottom wall 19, a top wall 20 (see FIG. 2), a first partition wall 21 and a second partition wall 22. The left wall 15 and the right wall 16 each has a shape of plate which is thin in the left-right direction X and is approximately rectangular along the up-down direction Z, while the left wall 15 and the right 16 are arranged opposed to each other at an interval in the left-right direction X. An outlet 23 penetrating through the left wall 15 along the left-right direction X is formed in a lower end of the left wall 15. An intake port 24 penetrating through the right wall 16 along the left-right direction X is formed in the right wall 16. A grid 25 is mounted at the intake port 24. The front wall 17 and the rear wall 18 each has a shape of a plate which is thin in the front-rear direction Y and is approximately rectangular along the up-down direction Z, while the front wall 17 is arranged between front ends of the left wall 15 and the right wall 16, and the rear wall 18 is arranged between rear ends of the left wall 15 and the right wall 16. An outtake port 26 penetrating through the rear wall 18 along the front-rear direction Y is formed in the rear wall 18. It should be indicated that, for the convenience of illustration, the outlet 23, the intake port 24 and the outtake port 26 are shown in positions at the same height in FIG. 1. However, the actual outlet 23 is located in a position not shown in FIG. 1, and the intake port 24 and the outtake port 26 may be arranged at different heights. In addition, for the convenience of illustration, in each figure subsequent to FIG. 1, respective positions of the outlet 23, the intake port 24 and the outtake port 26 may be sometimes different from those in FIG. 1.

The bottom wall 19 has a shape of a approximately rectangular plate which is thin in the up-down direction Z and horizontally extends. Four sides of the bottom wall 19 are respectively connected to respective lower ends of the left wall 15, the right wall 16, the front wall 17 and the rear wall 18 (see FIG. 2 and FIG. 3 below). Thus, the bottom wall 19 closes the space surrounded by the left wall 15, the right wall 16, the front wall 17 and the rear wall 18 from the lower side Z2. Feet 27 (see FIG. 2) in contact with ground that bears the shoe-washing device 1 are respectively arranged at four corners on a lower surface of the bottom wall 19. The top wall 20 has a shape of a approximately rectangular plate which is thin in the up-down direction Z and horizontally extends. Four sides of the top wall 20 are respectively connected to respective upper ends of the left wall 15, the right wall 16, the front wall 17 and the rear wall 18 (see FIG. 2 and FIG. 3). Thus, the top wall 20 closes a space surrounded by the left wall 15, the right wall 16, the front wall 17 and the rear wall 18 from the upper side Z1.

The first partition wall 21 has a shape of an approximately rectangular plate which is thin in the left-right direction X and extends along the up-down direction Z, and is arranged between the left wall 15 and the right wall 16. The first partition wall 21 is arranged between a position at the right side X2 of the front wall 17 and a position on the right side X2 of the rear wall 18. The lower end of the first partition wall 21 is arranged in a manner of keeping away from the bottom wall 19 towards the upper side Z1 (see FIG. 2). The second partition wall 22 has a shape of a approximately rectangular plate which is thin in the up-down direction Z, which horizontally extends at the same position as the lower end of the first partition wall 21 along the up-down direction Z, and which is arranged between the lower end of the first partition wall 21 and the left wall 15 and between the front wall 17 and the rear wall 18 (see FIG. 2 and FIG. 3). In FIG. 1, for the convenience of illustration, a member positioned on the lower side Z2 of the second partition wall 22 is represented by a dotted line or a dash dot line. A long inflow port 28, which is long in the left-right direction X, is formed in a rough center of the second partition wall 22 in a top view and penetrates the second partition wall 22 along the up-down direction Z.

Figure 2:
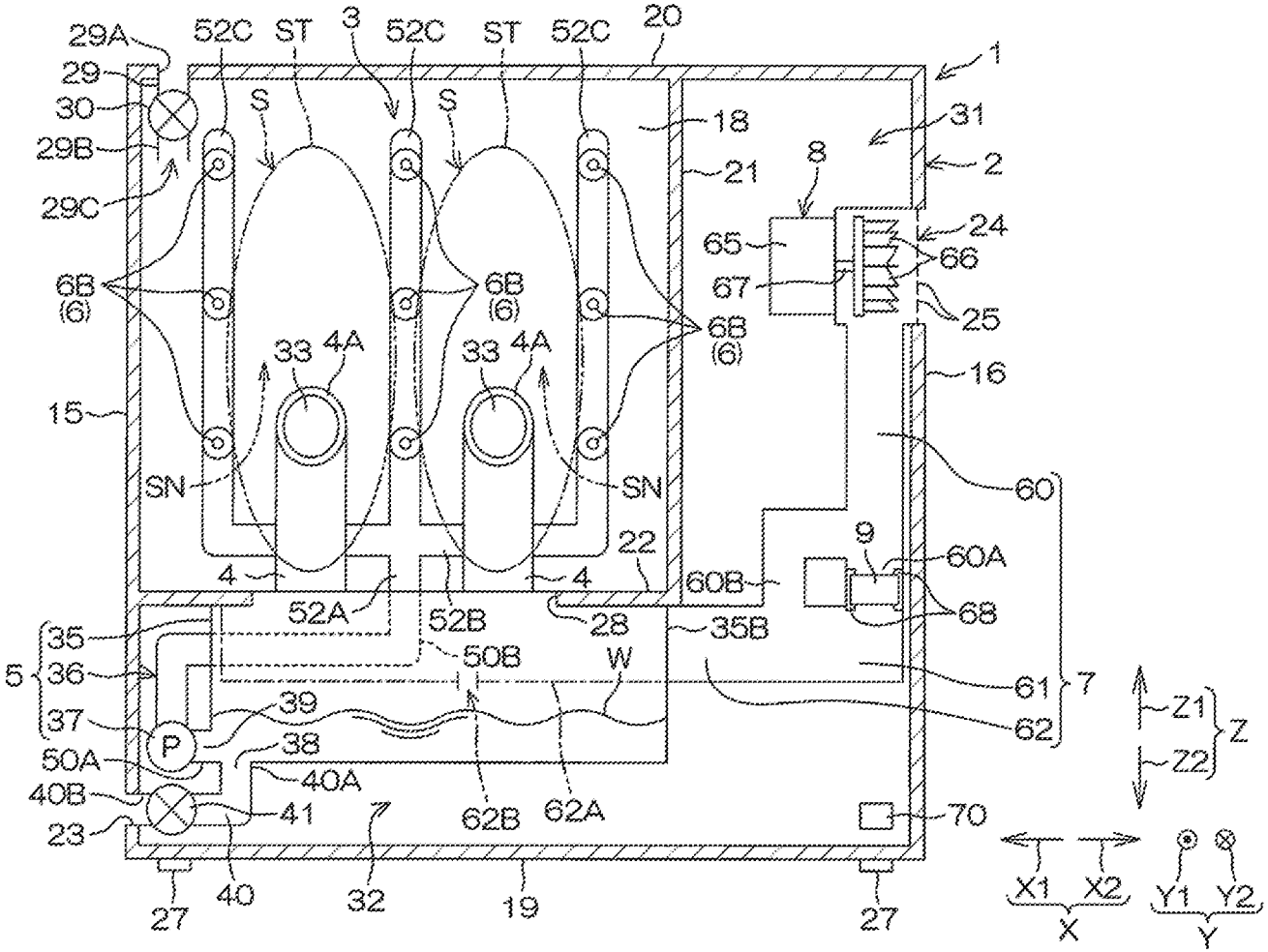
FIG. 2 is a schematic front view illustrating the shoe-washing device.

FIG. 2 is a schematic front view illustrating the shoe-washing device 1. With reference to FIG. 2, the accommodating chamber 3 is a approximately rectangular space surrounded by the left wall 15, the first partition wall 21, the front wall 17, the rear wall 18, the second partition wall 22 and the top wall 20. The top wall 20 forms a ceiling of the accommodating chamber 3. The accommodating chamber 3 has a width capable of abundantly accommodating a pair of shoes S as an object to be washed by the shoe-washing device 1. It should be indicated that, an inlet/outlet (not shown) used for putting in and taking out the shoes S from the accommodating chamber 3 and a door (not shown) for opening and closing the inlet/outlet are formed in any wall of the housing 2, such as the front wall 17 or the top wall 20. The outtake port 26 in the rear wall 18 is communicated with the accommodating chamber 3 from the rear side Y2 (see FIG. 1), and the inflow port 28 of the second partition wall 22 is communicated with the accommodating chamber 3 from the lower side Z2. A water supply path 29 is arranged in the accommodating chamber 3. With respect to the water supply path 29, one end 29A penetrates through the top wall 20 and is connected with a faucet (not shown), and a water supply port 29C facing the interior of the accommodating chamber 3 from the upper side Z1 is formed on the other end 29B. An openable/closable water supply valve 30 is arranged in the middle of the water supply path 29. It should be indicated that, the representation of the water supply path 29 and the water supply valve 30 is omitted in figures except FIG. 2.

In addition to the accommodating chamber 3, the inner space of the housing 2 further includes a longitudinal space 31 and a transverse space 32. The longitudinal space 31 is a space, which is approximately longitudinally long and is surrounded by respective parts of the front wall 17, the rear wall 18, the bottom wall 19 and the top wall 20 on the right side X2 as well as the right wall 16 and the first partition wall 21. The transverse space 32 is space, which is approximately transversely long and is surrounded by parts of the front wall 17, the rear wall 18 and the bottom wall 19 on the left side X1 as well as a part of the lower side Z2 of the left wall 15 and the second partition wall 22. The transverse space 32 continuously extends from the lower end of the longitudinal space 31 to the left side X1 and is arranged right under the accommodating chamber 3.

In a case of one pair of shoes S, there are two holding parts 4. The two holding parts 4 are arranged along the left-right direction X in a region closer to the rear side Y2 than the inflow port 28 of the second partition wall 22 (also see FIG. 1). Each of the holding parts 4 is hollow and has an opening part 33. The holding part 4 in the present embodiment has a shape of a tube that extends from the second partition wall 22 to the upper side Z1, and the opening part 33 is arranged on an upper end of the holding part 4. On the upper end of the holding part 4, an edge-covered peripheral part 4A of the opening part 33 is obliquely formed in a manner of facing the upper side Z1 to deviate from the rear side Y2 (see FIG. 3).

The injection mechanism 5 includes a recycling tank 35, a flow path 36 and a pump 37. The recycling tank 35 is an approximately rectangular tank with a size capable of being accommodated in the transverse space 32 and is fixed onto the second partition wall 22 from the lower side Z2. The inflow port 28 of the second partition wall 22 is in a state of being communicated with an interior of the recycling tank 35 from the upper side Z1. A water outlet 38 and an outflow port 39 are formed in a lower end part of the recycling tank 35.

One end 40A of a drainage path 40 is connected to the water outlet 38, and the other end 40B of the drainage path 40 is connected to the outlet 23 in the left wall 15. The other end part 40B can be pulled out of the housing 2 (i.e., the exterior of the shoe-washing device 1) through the outlet 23. An openable/closable drainage valve 41 is arranged in the middle of the drainage path 40. When the water supply valve 30 is opened in a state where the drainage valve 41 is closed, water from the faucet flows into the accommodating chamber 3 via the water supply path 29 through the water supply port 29C and is accumulated in the recycling tank 35 through the inflow port 28. It should be indicated that, a wavy line in the recycling tank 35 in FIG. 2 is a water surface W of the water accumulated in the recycling tank 35. When the drainage valve 41 is opened in a state where the water is accumulated in the recycling tank 35, the water in the recycling tank 35 is drained out of the device from the other end 40B via the drainage path 40.

Figure 3:
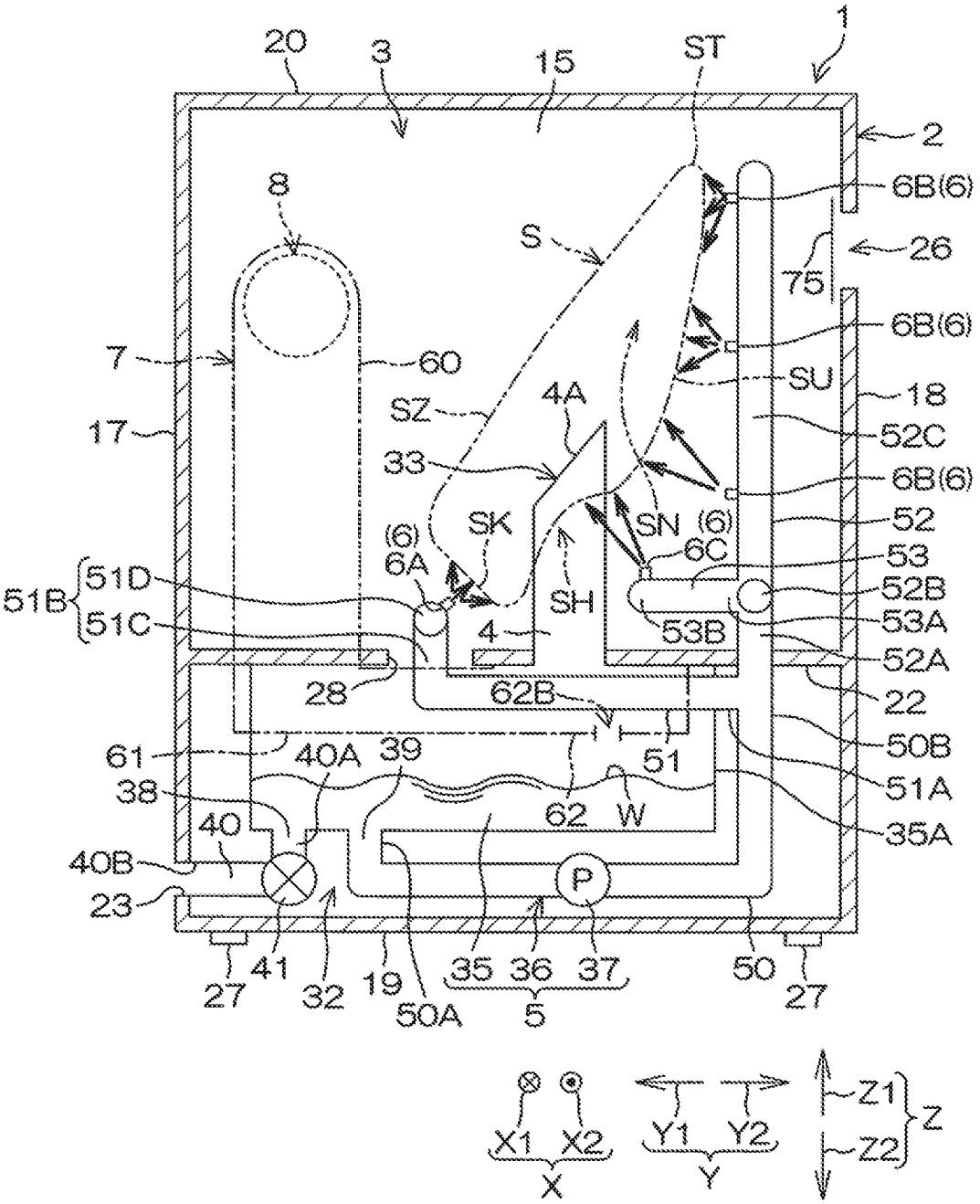
FIG. 3 is a schematic longitudinal-section right view illustrating a shoe-washing device.

FIG. 3 is a schematic longitudinal-section right view illustrating a shoe-washing device 1. With reference to FIG. 3 while referring to FIG. 1 and FIG. 2, the flow path 36 has a shape of a tube including an outflow path 50, a first branch path 51, a second branch path 52 and third branch paths 53.

The outflow path 50 is arranged in the transverse space 32in a manner of surrounding the recycling tank 35. One end 50A of the outflow path 50 is connected to the outflow port 39 of the recycling tank 35. The outflow path 50 extends from the end 50A and goes around to the rear side Y2 of the recycling tank 35, and the other end 50B of the outflow path 50 extends towards the upper side Z1 on the rear side Y2 of the recycling tank 35 and is branched into the first branch path 51 and the second branch path 52.

The first branch path 51 penetrates through a rear wall 35A of the recycling tank 35 in a state where one end 51A of the first branch path 51 is connected to the other end 50B of the outflow path 50, and horizontally extends towards the front side Y1 in the recycling tank 35 to the inflow port 28 of the second partition wall 22. Since a gap between the first branch path 51 and part of the rear wall 35A in the proximity of the first branch path 51 is blocked by fillers (not shown), the water in the recycling tank 35 may be prevented from leaking out via the gap. The other end 51B of the first branch path 51 includes: a longitudinal part 51C which is bent to form an approximately right angle and extends towards the upper side Z1; and a transverse part 51D extending from an upper end (which is exposed from the inflow port 28 of the longitudinal part 51C to the upper side Z1) of the longitudinal part 51C to both outer sides in the left-right direction X (also see FIG. 1). The upper end of the longitudinal part 51C is connected to a central part of the transverse part 51D extending in the left-right direction X.

The second branch path 52 includes: a bottom part 52A which penetrates through the second partition wall 22 from the other end 50B of the outflow path 50 and extends towards the upper side Z1; a transverse part 52B extending from an upper end of the bottom part 52A to both outer sides in the left-right direction X; and three longitudinal parts 52C extending from the transverse part 52B to the proximity of the top wall 20 (see FIG. 2). The transverse part 52B is arranged in a region along the rear wall 18 at the lower end of the accommodating chamber 3, and the upper end of the bottom part 52A is connected to a central part of the transverse part 52B in the left-right direction X. The three longitudinal parts 52C respectively extend to the upper side Z1 from the central part and both ends of the transverse part 52B in the left-right direction X.

The third branch paths 53 are branched from the transverse part 52B of the second branch path 52 and horizontally extend towards the front side Y1. Two third branch paths 53 are arranged along the left-right direction X. With respect to the third branch path 53 on the left side X1, one end 53A is connected to a portion between the left end and the central part of the transverse part 52B, and the other end 53B is arranged opposed to the holding part 4 on the left side X1 from the rear side Y2 at an interval (see FIG. 1). With respect to the third branch path 53 on the right side X2, one end part 53A is connected to a portion between the right end and the central part of the transverse part 52B, and the other end 53B is arranged opposed to the holding part 4 on the right side X2 from the rear side Y2 at an interval (see FIG. 1).

The pump 37 is a centrifugal pump with a built-in rotary impeller (not shown), and is arranged in the middle of the outflow path 50. A plurality of nozzles 6 are arranged in the accommodating chamber 3. The quantity of the nozzles 6 in the present embodiment is 14. The 14 nozzles 6 include: three first nozzles 6A arranged on the first branch path 51, nine second nozzles 6B arranged on the second branch path 52, and two third nozzles 6C arranged on the third branch path 53 (also see FIG. 1 and FIG. 2). One first nozzle 6A is arranged at respective one of a central part and both ends of a rear side surface of the transverse part 51D of the first branch path 51 in the left-right direction X, and faces the rear side Y2 (see FIG. 1). One second nozzle 6B is arranged at respective one of a central part and both ends of a front side surface of each longitudinal part 52C of the second branch path 52 in the up-down direction Z, and faces the front side Y1 (see FIG. 2). One third nozzle 6C is arranged on respective one of an upper side surface at the other end 53B of each of the third branch paths 53, and faces the upper side Z1 (see FIG. 1). Thus, the recycling tank 35 and each of the nozzles 6 are connected via the flow path 36 including the first branch path 51, the second branch path 52 and the third branch paths 53.

With reference to FIG. 2, the pipe 7 includes: a longitudinal pipe 60 extending in the up-down direction Z along the right wall 16 in the longitudinal space 31, a first transverse pipe 61 extending towards the rear side Y2 along the right wall 16 from the lower end of the longitudinal pipe 60, and a second transverse pipe 62 extending towards the left side X1 from the rear end of the first transverse pipe 61 (see FIG. 1). The intake port 24 of the right wall 16 is communicated with an interior of the longitudinal pipe 60 from the right side X2. A lower end of the longitudinal pipe 60 is branched into a main pipe 60A and a bypass pipe 60B, and the main pipe 60A and the bypass pipe 60B are respectively connected to the first transverse pipe 61 from the upper side Z1.

As shown by the dash dot line, a left side part 62A of the second transverse pipe 62 penetrates through the right wall 35B of the recycling tank 35, and is arranged just under the two holding parts 4 in the recycling tank 35. Since a gap between the periphery of the left side part 62A of the right wall 35B and the left side part 62A is blocked by fillers (not shown), the water in the recycling tank 35 may be prevented from leaking via the gap. The left side part 62A is connected to each of the holding parts 4 from the lower side Z2, and the interior of each of the holding parts 4 and the interior of the left side part 62A are in a state of mutual communication. A drainage hole 62B that faces the interior of the recycling tank 35 from the upper side Z1 is formed in a bottom of the left side part 62A.

The air supply part 8 is a so-called fan, and includes: a motor 65 fixed to the upper end of the longitudinal pipe 60 from the left side X1; and rotating blades 66 arranged at an upper end in the interior of the longitudinal pipe 60. The motor 65 has an output shaft 67, and the output shaft 67 is arranged at the upper end of the interior of the longitudinal pipe 60 in a manner of protruding towards the right side X2. A plurality of rotating blades 66 are arranged and fixed to the output shaft 67 in a manner of radially extending from the output shaft 67.

The heating part 9 is a heater composed of a heat coil and is arranged on the main pipe 60A. A claw-like positioning part 68 is arranged on an inner surface of the main pipe 60A. By clamping the heating part 9 using the positioning part, the heating part 9 is positioned in the main pipe 60A.

A control part 70 composed of a microcomputer and the like is arranged in the housing 2, such as in the longitudinal space 31. In addition, an operation part (not shown) including keys and the like operated by a user is arranged on an outer surface of the housing 2. The control part 70 is electrically connected with the operation part, the air supply part 8, the heating part 9, the water supply valve 30, the pump 37 and the drainage valve 41 respectively through wiring (not shown). Therefore, the control part 70 can receive the operation of the user on the operation part, or control the operations of the air supply part 8, the heating part 9 and the pump 37, or respectively open and close the water supply valve 30 and the drainage valve 41.

Next, a cleaning operation of the shoes S executed by the shoe-washing device 1 is described. The cleaning operation includes: a cleaning process for cleaning the shoes S using the cleaning fluid mixed with a detergent and rinsing the shoes S; and a fluid removal process for dewatering the shoes S after the cleaning process and drying the shoes.

Before the cleaning operation is started, the above door (not shown) is opened by the user, and a pair of shoes S are accommodated in the accommodating chamber 3. At this moment, with reference to FIG. 3, with respect to the pair of shoes S accommodated in the accommodating chamber 3, the user inserts the holding parts 4 into the inner space SN of the shoes S from the toplines SH of the shoes S one by one from the lower side Z2. Thus, the pair of shoes S is arranged along the left-right direction X in the accommodating chamber 3, and each of the holding parts 4 holds one of the shoes S in a longitudinal posture in a manner of enabling the toplines SH to face the lower side Z2. In such a state, the opening part 33 at the upper end of each of the holding part 4 faces the inner space SN of one of the shoes S. In detail, the opening parts 33 are arranged in a manner of facing toecaps ST of the shoes S held by the holding parts 4. It should be indicated that, the shoes S in the longitudinal posture may be in an upright state, and may also be in a slightly oblique state in a manner of enabling the toecaps ST to deviate towards the rear side Y2 relative to heels SK, as shown in FIG. 3.

In the state where the shoes S are accommodated in the accommodating chamber 3, the first nozzles 6A face the heels SK of the shoes S from the front side Y1, the second nozzles 6B face an upper part SU (which covers an instep) of the shoes S from the rear side Y2, and the third nozzles 6C face the toplines SH of the shoes S from the lower side Z2.

As mentioned above, after the user who accommodates the shoes S in the accommodating chamber 3 closes the above door (not shown) to seal the accommodating chamber 3, the user indicates the shoe-washing device 1 to start the cleaning operation by operating the operation part (not shown). Then, the control part 70 starts the washing process, and the water supply valve 30 is opened while the drainage valve 41 is in a closed state. Thus, as mentioned above, the water from the faucet (not shown), strictly speaking, running water, passes through the water supply path 29, the accommodating chamber 3 and the inflow port 28 and is accumulated in the recycling tank 35. In other words, water is supplied to the recycling tank 35 by the shoe-washing device 1. When a water surface W in the recycling tank 35 reaches a specified water level, the control part 70 closes the water supply valve 30 to stop supplying the water. At time points before and after water supply, the detergent is fed into the accommodating chamber 3 by the user, or during water supply, the detergent accommodated in a detergent accommodating chamber (not shown) connected with the water supply path 29 is dissolved in the running water. Thus, cleaning fluid produced by dissolving the detergent into the running water is accumulated in the recycling tank 35. It should be indicated that, since a plate-like opposed part 75 is oppositely configured from the front side Y1 of the outtake port 26 in the rear wall 18 of the housing 2, the running water or cleaning fluid which is splashed in the accommodating chamber 3 can be prevented from reaching the outtake port 26 and leaking out of the device from the outtake port 26.

Then, the control part 70 drives the pump 37. Thus, the cleaning fluid in the recycling tank 35 flows through the flow path 36 and exits in each of the first branch path 51, the second branch path and the third branch paths 53, as shown by thick solid line arrows, is supplied into the accommodating chamber 3 through the first nozzles 6A, the second nozzles 6B and the third nozzles 6C, and is injected to the shoes S in the accommodating chamber 3 at high pressure. The shoes S to which the cleaning fluid is injected are cleaned in the manner of removing mud and other dirt under high-pressure injection impulsive force or chemically decomposing the dirt using the cleaning fluid. Particularly, an entire region of the heel SK of each of the shoes S is cleaned by the cleaning fluid injected from the first nozzles 6A to the shoes S; an entire region of an upper part SU of each of the shoes S is cleaned by the cleaning fluid injected from the second nozzles 6B to the shoe S; and an entire region of a periphery of the topline SH of each of the shoes S and the inner space SN is cleaned by the cleaning fluid injected from the third nozzles 6C to the shoe S.

Thus, in the shoe-washing device 1, even if the shoes S are not rubbed with brushes, high-pressure cleaning fluid injected from each of the nozzles 6 may also maintain the same cleaning capability as that in a condition where the shoes S are scrubbed by the brushes, and the shoes S may be wholly cleaned completely in a manner of not being damaged. In addition, since the shoes S in the accommodating chamber 3 are held in a longitudinal posture by the holding parts 4, in addition to the cleaning fluid injected from the nozzles 6 to the shoes S, the cleaning fluid that flows downwards from the surfaces of the shoes S can also be used to clean the shoes S. In addition, since the shoes S in the accommodating chamber 3 may be cleaned in a static state held by the holding parts 4 without forced movement, the shoes S can be cleaned without deformation.

Cleaning fluid that drops from the shoes S after injected from the nozzles 6 to the shoes S in the accommodating chamber 3 and cleaning fluid which is injected into the accommodating chamber 3 from the nozzles 6 but is not injected onto the shoes S may drop into the recycling tank 35 via the inflow port 28 and then may be recycled in the recycling tank 35. In the cleaning fluid injected into the inner space SN of the shoes S from the third nozzles 6C, cleaning fluid that enters the holding parts 4 through the opening parts 33 at the upper end of the holding parts 4 from the inner space SN reaches the interior of the second transverse pipe 62 of the pipe 7 from the interior of the holding part 4 by virtue of own weight, and then drops into the recycling tank 35 from the drainage hole 62B in the bottom of the second transverse pipe 62.

Since the pump 37 is continuously driven, the cleaning fluid recycled into the recycling tank 35 flows through the flow path 36 and is injected into the accommodating chamber 3 through the first nozzles 6A, the second nozzles 6B and the third nozzles 6C. Thus, the cleaning fluid circulates between the accommodating chamber 3 and the recycling tank 35. Therefore, even if a small amount of the cleaning fluid exists, the shoes S may be cleaned by cyclically using the cleaning fluid. The pump 37 is stopped and the drainage valve 41 is opened by the control part 70 after circulation of the cleaning fluid lasts for specified time. Thus, the cleaning fluid in the accommodating chamber 3 and the recycling tank 35 is discharged out of the device via the drainage path 40. Then, the drainage valve 41 is closed by the control part 70.

Next, the water supply valve 30 is opened for specified time by the control part 70, and the pump 37 is driven after the running water accumulated in the recycling tank 35 reaches a specified water level. Thus, the running water circulates between the accommodating chamber 3 and the recycling tank 35, and is injected to the shoes S in the accommodating chamber 3 from each of the nozzles 6 at high pressure so as to rinse the shoes S in the accommodating chamber 3. As mentioned above, the water that enters the holding parts 4 through the opening parts 33 at the upper end of the holding parts 4 from the inner space SN of the shoes S reaches the second transverse pipe 62, and then drops into the recycling tank 35 from the drainage hole 62B in the bottom of the second transverse pipe 62.

The driving of the pump 37 is stopped and the drainage valve 41 is opened for specified time by the control part 70 after such running water circulates for specified time. Thus, the water in the accommodating chamber 3 and the recycling tank 35 is drained out of the device via the drainage path 40, and the water that leaks out of the naturally placed shoes S is also drained out of the device. The cleaning process is ended after the specified time elapsed.

The control part 70 drives the air supply part 8 to enable rotating blades 66 to rotate after the cleaning process, so that the fluid removal process is started. With reference to FIG. 2, air outside the device is sucked into the pipe 7 from the intake port 24 of the housing 2. The air sucked into the pipe 7 violently flows in the pipe 7 according to a sequence of the longitudinal pipe 60, the first transverse pipe 61 and the second transverse pipe 62 by virtue of rotation of the rotating blades 66, and is supplied into each of the holding parts 4 from the pipe 7.

The air supplied into each of the holding parts 4 violently flows into the inner space SN of the shoes S from the opening parts 33 at the upper end of the holding parts 4 in a pressurized high-pressure state through the rotating blades 66, and then the cleaning fluid and water may leak out of the shoes S. The leaking water spills from the toplines SH (see FIG. 3) facing the lower side Z2. Therefore, the cleaned shoes S may be efficiently dewatered from the side of the inner space SN by repeatedly enabling the air to flow into the inner space SN of the shoes S from the opening parts 33 of the holding parts 4. Particularly, the opening parts 33 are arranged in a manner of facing the toecaps ST of the shoes S held by the holding parts 4. Thus, the air that flows into the inner space SN of the shoes S from the opening part 33 of the holding parts 4 is completely filled in the whole inner space SN, and the water wholly leaks out of the shoes S, so the cleaned shoes S may be efficiently dewatered. The air discharged into the inner space SN finally flows into the accommodating chamber 3 outside the shoes S from the toplines SK, and then is discharged out of the device from the outtake port 26 (see FIG. 3) in the rear wall 18 of the housing 2.

As mentioned above, the water that enters each of the holding parts 4 through the opening part 33 at the upper end of each of the holding parts 4 from the inner space SN of the shoes S reaches the interior of the second transverse pipe 62 and then drops into the recycling tank 35 from the drainage hole 62B in the bottom of the second transverse pipe 62. Thus, the water leaking out of the shoes S may be recycled in the recycling tank 35 in a manner of not attaching to the shoes S again. Therefore, the cleaned shoes S may be efficiently dewatered.

The control part 70 enables the heating part 9 to operate in a state of enabling the rotating blades 66 to continuously rotate after specified time from the beginning of the rotation of the rotating blades 66. Thus, the air supplied into each of the holding parts 4 from the pipe 7 by the air supply part 8 is heated by the heating part 9 in the main pipe 60A while passing through the main pipe 60A of the longitudinal pipe 60. Thus, the heated air is changed into hot air to flow into the inner space SN of the shoes S from the opening parts 33 of the holding parts 4, so the shoes S can be dried from the inner side by virtue of the hot air. In addition, the shoes S are dried from the outer side by enabling the hot air to be completely filled in the accommodating chamber 3. It should be indicated that, the air that passes through the bypass pipe 60B of the longitudinal pipe 60 flows together with the air heated in the main pipe 60A in the first transverse pipe 61, so that the hot air that flows from the opening parts 33 of the holding parts 4 can be prevented from reaching a high temperature exceeding a necessary temperature.

The air supply part 8 and the heating part are deactivated so as to end the fluid removal process by the control part 70 after the heating part 9 is operated for specified time. Thus, a series of cleaning operations are ended. The user opens the above door (not shown) and takes out the cleaned and dried shoes S from the accommodating chamber 3 after the cleaning operations are ended.

As mentioned above, in the shoe-washing device 1, firstly, the shoes S are accommodated in the accommodating chamber 3 and held on the holding parts 4, and then, even if the shoes S are not moved in the accommodating chamber 3, a series of cleaning operations may also be implemented.

The present disclosure is not limited to embodiments described above, and can be subjected to various changes in a scope recorded in claims.

Figure 4:
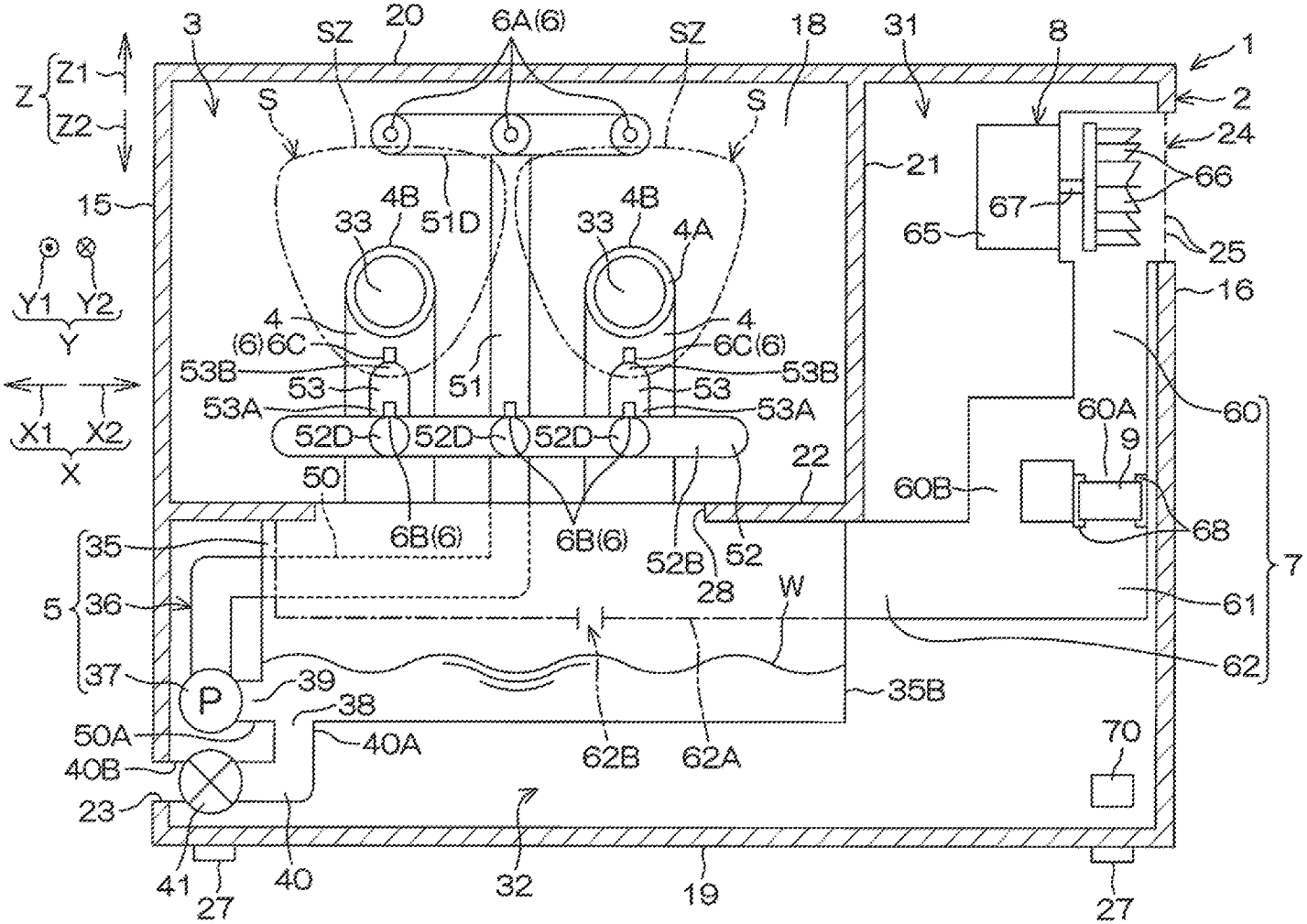
FIG. 4 is a schematic front view illustrating a shoe-washing device in a variation.
Figure 5:
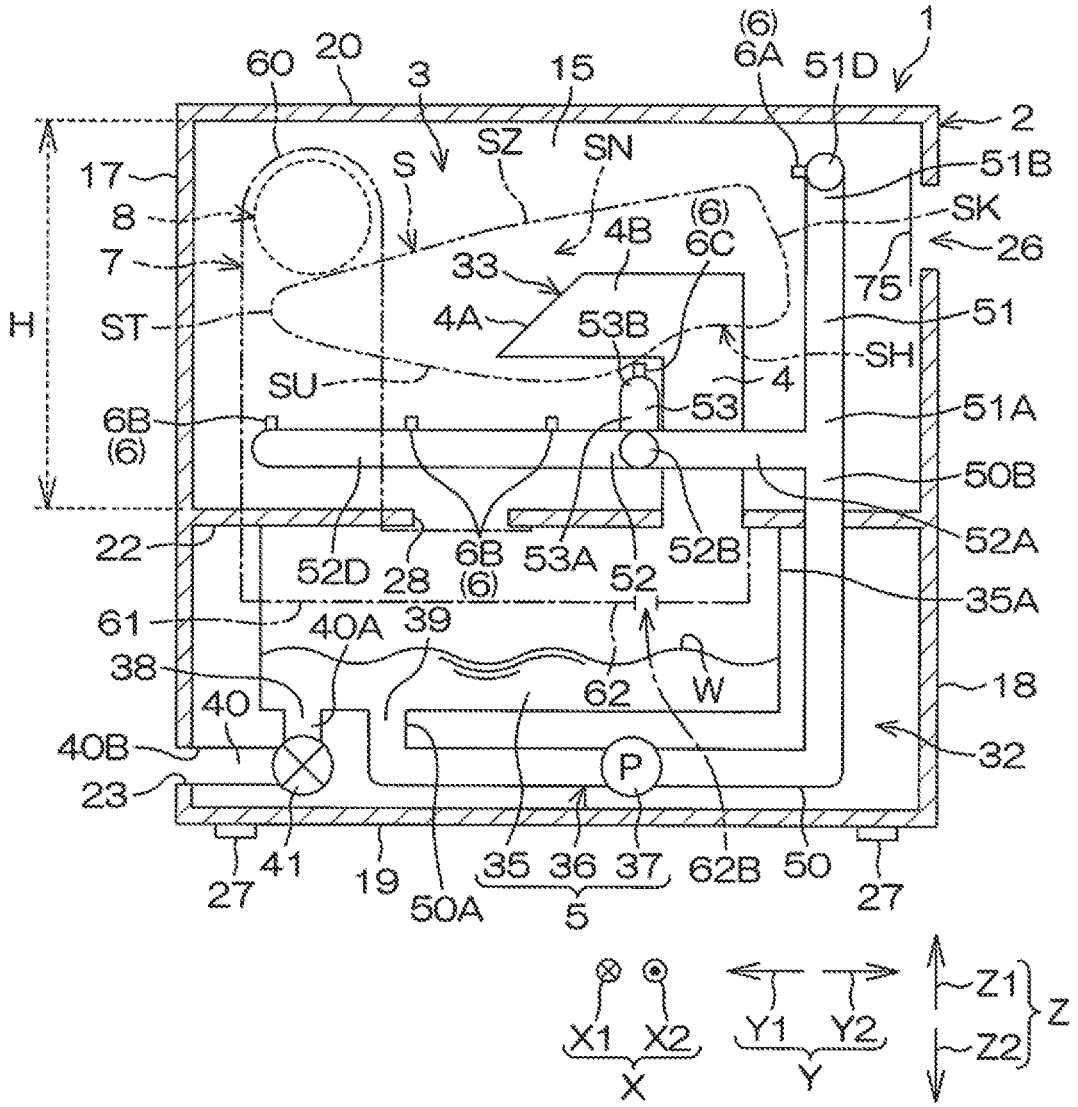
FIG. 5 is a schematic longitudinal-section right view illustrating a shoe-washing device in the variation.

FIG. 4 is a schematic front view illustrating a shoe-washing device 1 in a variation embodiment. FIG. 5 is a schematic longitudinal-section right view illustrating a shoe-washing device 1 in a variation embodiment. In FIG. 4 and FIG. 5, parts which are identical with parts described in FIGS. 1-3 are endowed with the same reference signs, and description of the parts is omitted.

In variation embodiments shown in FIG. 4 and FIG. 5, as shown in FIG. 5, each of the holding parts 4 is formed in a manner of bending a top end 4B provided with the opening part 33 to be a rough right angle towards the front side Y1. The other end 50B of the outflow path 50 of the flow path 36 is arranged in a manner of penetrating through the second partition wall 22 on the rear side Y2 of each of the holding parts 4 and being exposed into the accommodating chamber 3 from the lower side Z2. The above first branch path 51 vertically extends to a position near the top wall 20 towards the upper side Z1 in a state where one end 51A of the first branch path 51 is connected to the other end 50B of the outflow path. With respect to the first branch path 51, the other end 51B forming an upper end of the first branch path is connected to the central part of the transverse part 51D in the left-right direction X. The first nozzles 6A are respectively arranged in the center and at both ends in the left-right direction X on a front side surface of the transverse part 51D, and face the front side Y1 (see FIG. 4).

With respect to the second branch path 52, the bottom part 52A extends from the other end 50B of the outflow path 50 to the front side Y1, and the transverse part 52B extends from the front end of the bottom part 52A to two outer sides in the left-right direction X on the lower side Z2 of the top end 4B of the holding parts 4. The second branch path 52 of the variation embodiment includes three transverse parts 52D extending from the transverse part 52B to a position near the front wall 17, instead of the above three longitudinal parts 52C (see FIG. 2). The three transverse parts 52D extend from a central part and both side parts of the transverse part 52B in the left-right direction X to the front side Y1 one by one (see FIG. 4). The second nozzles 6B are respectively arranged in the central part and both ends of the front-rear direction Y on an upper side surface of each of the transverse parts 52D, and face the upper side Z1.

Two third branch paths 53 are arranged in a manner of arranging along the left-right direction X, are branched from the transverse part 52B of the second branch path 52 and vertically extend to the upper side Z1. With respect to the third branch path 53 on the left side X1, one end 53A is connected to a portion between the left end and the central part of the transverse part 52B; the other end 53B is arranged opposed to the holding part 4 on the left side X1 at an interval from the front side Y1, and arranged opposed to the top end 4B of the holding part 4 from the lower side Z2 at an interval (also see FIG. 4). With respect to the third branch path 53 on the right side X2, one end 53A is connected to a portion between the right end and the central part of the transverse part 52B; the other end 53B is arranged opposed to the holding part 4 on the right side X2 at an interval from the front side Y1, and arranged opposed to the top end 4B of the holding part 4 from the lower side Z2 at an interval (also see FIG. 4). One third nozzle 6C is arranged at the other end 53B of each of the third branch paths 53, and faces the upper side Z1.

Under a condition where the cleaning operation is executed by a shoe-washing device 1 in the variation embodiment, the top end 4B bent towards the front side Y1 on each of the holding parts 4 is inserted from one of the toplines SH of the shoes S from the lower side Z2 and then inserted into the inner space SN of the shoe S in a manner of facing the toecap ST when the shoe S is accommodated in the accommodating chamber 3 by the user. Thus, the pair of shoes S is arranged along the left-right direction X in the accommodating chamber 3, and each of the holding parts 4 holds one of the shoes S in a horizontal transverse posture in a manner of enabling the toecaps ST to face the front side Y1 and enabling the toplines SH to face the lower side Z2. Thus, the height H of the accommodating chamber 3 may be suppressed to a small size, so the shoe-washing device 1 may be compactly formed in the up-down direction Z.

In the shoe-washing device 1 in the variation embodiment, the first nozzles 6A face the heels 6K of the shoes S from the rear side Y2, the second nozzles 6B face the upper part SU of the shoes S from the lower side Z2 and the third nozzles 6C face the toplines SH of the shoes S from the lower side Z2 in a state where all the shoes are accommodated in the accommodating chamber 3. When the cleaning operations are performed in this state, the entire region of the heels SK of the shoes S is cleaned by the cleaning fluid injected from the first nozzles 6A to the shoes S, the entire region of the upper parts SU of the shoes S is cleaned by the cleaning fluid injected from the second nozzles 6B to the shoes S, and the entire region of a periphery of the toplines SH of the shoes S and the inner space SN is cleaned by the cleaning fluid injected from the third nozzles 6C to the shoes S.

In the shoe-washing device 1 in the variation embodiment, the holding parts 4 hold the shoes S in the transverse posture in a manner of enabling the soles SZ to face the upper side Z1. In a cleaning process under this condition, the soles SZ may be efficiently cleaned by cleaning fluid which is injected upwards from the second nozzles 6B to beat the top wall 20 of the accommodating chamber 3 and drops.

In addition, the shoe-washing device 1 exists as an individual device in above embodiments, or may be assembled to a washing machine and any other laundry appliance for use. At this moment, the shoe-washing device 1 may connect the water supply path 29 to a water supply path of the laundry appliance and connect the drainage path 40 to a drainage path of the laundry appliance. In addition, the control part 70 of the shoe-washing device 1 may execute the cleaning operation by receiving an instruction from a control part of the laundry appliance. It should be indicated that, assuming that the shoe-washing device 1 is arranged on a lower part or an upper part of the laundry appliance, in order to suppress a longitudinal size of the laundry appliance to be small, ideally, the shoe-washing device 1 holds the shoes S in the transverse posture like the above variation embodiments.

In addition, the present disclosure may be arranged in such a manner: the other end 53B, at which the third nozzles 6C are arranged, of the third branch path 53 penetrates through the interior of each of the holding parts 4, and the third nozzles 6C are exposed from the opening part 33 of each of the holding parts 4. Thus, the cleaning fluid may be accurately injected into the inner space SN of the shoes S by the third nozzles 6C.

In addition, a filter used for capturing foreign matters contained in the cleaning fluid may be arranged at the inflow port 28 through which the cleaning fluid drops towards the recycling tank 35 from the accommodating chamber 3. In order to achieve the same aim, the filter may also be arranged at the one end 50A, which is connected to the outflow port 39 of the recycling tank 35, of the outflow path 50 of the flow path 36. The filter may be arranged in a manner of exposing into the recycling tank 35 from the outflow port 39.

In addition, shapes, sizes and layouts of the pipe 7, the recycling tank 35, the flow path 36 and the like may be freely changed. In addition, positions of the air supply part 8 and the heating part 9 in the pipe 7 may also be changed. In addition, the water supply path 29 may be arranged in such a manner: the other end 29B is connected to the recycling tank 35, and the water supply port 29C faces the interior of the recycling tank 35. Thus, the water may be directly supplied into the recycling tank 35 from the water supply path 29.

What is claimed is:

1. A shoe-washing device, comprising:

an accommodating chamber for accommodating a pair of shoes and supplied with cleaning fluid;

a plurality of holding parts each being hollow and having an opening part, wherein the opening parts of the holding parts are inserted into inner space of the shoes from toplines of the shoes inside the accommodating chamber such that the shoes are held in such a manner that the toplines face a lower side, and the opening parts face the inner space of the shoes;

a pipe connected to the holding parts;

an air supply part for supplying air into the holding parts through the pipe; and a recycling tank for recycling the cleaning fluid from the accommodating chamber;

wherein a drainage hole is formed in a bottom of a part of the pipe arranged in the recycling tank, water reaches the interior of the pipe through the opening parts and interiors of the holding parts from the shoes held by the holding parts and drops into the recycling tank through the drainage hole.

2. The shoe-washing device according to claim 1, wherein the opening parts are arranged in a manner of facing toecaps of the shoes held by the holding parts.

3. The shoe-washing device according to claim 1, wherein the shoe-washing device further comprises: a heating part for heating air supplied through the pipe to the interior of the holding parts by the air supply part.

4. The shoe-washing device according to claim 2, wherein the shoe-washing device further comprises: a heating part for heating air supplied through the pipe to the interior of the holding parts by the air supply part.

* * * * *